US008579038B2

(12) United States Patent
Atkins et al.

(10) Patent No.: US 8,579,038 B2
(45) Date of Patent: Nov. 12, 2013

(54) SEALING APPARATUS

(75) Inventors: Nicholas Atkins, Banchory (GB); Timothy Clarke, Aberdeen (GB)

(73) Assignee: Rubberatkins Limited, Aberdeen (GB)

( * ) Notice: Subject to any disclaimer, the term of this patent is extended or adjusted under 35 U.S.C. 154(b) by 374 days.

(21) Appl. No.: 12/513,736

(22) PCT Filed: Nov. 2, 2007

(86) PCT No.: PCT/GB2007/004177

§ 371 (c)(1), (2), (4) Date: Dec. 15, 2009

(87) PCT Pub. No.: WO2008/056109

PCT Pub. Date: May 15, 2008

(65) Prior Publication Data

US 2010/0101776 A1 Apr. 29, 2010

(30) Foreign Application Priority Data

Nov. 8, 2006 (GB) ..... 0622241.8

(51) Int. Cl.
*E21B 33/12* (2006.01)

(52) U.S. Cl.
USPC ..... 166/387; 166/121; 166/202

(58) Field of Classification Search
USPC ..... 166/121, 202, 187, 387
See application file for complete search history.

(56) References Cited

U.S. PATENT DOCUMENTS

| | | | | |
|---|---|---|---|---|
| 2,972,379 | A * | 2/1961 | Brown | 166/313 |
| 2,976,543 | A | 3/1961 | Turner et al. | |
| 2,988,148 | A * | 6/1961 | Conrad et al. | 277/337 |
| 3,019,842 | A * | 2/1962 | Nutter | 166/126 |
| 3,227,463 | A | 1/1966 | Wiese | |
| 3,389,917 | A * | 6/1968 | McGill et al. | 277/335 |
| 3,422,673 | A | 1/1969 | Lebourg | |
| 3,526,277 | A * | 9/1970 | Scott | 166/121 |
| 3,666,010 | A * | 5/1972 | Harris | 166/134 |
| 3,695,352 | A | 10/1972 | McGill | |
| 3,701,382 | A | 10/1972 | Williams | |
| 4,281,840 | A * | 8/1981 | Harris | 277/342 |
| 5,185,890 | A | 2/1993 | Dismore et al. | |
| 5,343,946 | A | 9/1994 | Morrill | |
| 5,813,460 | A | 9/1998 | Ringgenberg et al. | |
| 6,626,240 | B1 | 9/2003 | Sunde | |
| 6,918,441 | B2 * | 7/2005 | Dallas | 166/202 |
| 7,308,945 | B2 | 12/2007 | Atkins et al. | |
| 2005/0028990 | A1 * | 2/2005 | Atkins et al. | 166/387 |

FOREIGN PATENT DOCUMENTS

| | | | |
|---|---|---|---|
| GB | 872843 | A | 7/1961 |
| GB | 2136905 | A | 9/1984 |
| WO | 00/09825 | A1 | 2/2000 |

OTHER PUBLICATIONS

International Search Report for PCT/GB2007/004177.

* cited by examiner

*Primary Examiner* — Nicole Coy
(74) *Attorney, Agent, or Firm* — Buchanan Nipper

(57) ABSTRACT

A sealing apparatus for sealing an annulus is described. The apparatus comprises a first sealing element (20) adapted for sealing the annulus against fluid pressure from above the sealing apparatus and adapted to be actuated by fluid pressure from above the apparatus and a second sealing element (40) adapted for sealing the annulus against fluid pressure from below the sealing apparatus and adapted to be actuated by fluid pressure from below the apparatus. In use, the sealing elements are arranged such that the second sealing element is above the first sealing element.

54 Claims, 12 Drawing Sheets

SEALING APPARATUS

FIELD OF THE INVENTION

The present invention relates to an improved sealing apparatus, and particularly to a sealing apparatus suitable for sealing a well annulus from both uphole and downhole pressure.

BACKGROUND TO THE INVENTION

Sealing devices are used in well bores to seal the annulus between the well casing and a tubular, such as a production tube passing through the well bore. Conventional devices, such as packers, come in a number of types. Two of the most widely used types are inflatable packers and compressed element packers. In these packers, the seal is created by the application of pressure through the sealing element. One of the drawbacks of these types of packers is that enough pressure has to be applied during the setting of the packer to make a seal strong enough to withstand all the forces that will be applied to the seal during use A cup seal packer, of the type described in the applicant's co-pending European Patent Application EP1503031 overcomes some of the drawbacks of conventional packers by providing a cup seal which requires only sufficient load be applied to form an initial contact seal with the well casing. The cup seal packer is self-energising by using well pressure to make the seal with the well casing. One of the drawbacks of a cup seal packer of this type, however, is they can only safely hold pressure from one direction. To overcome this drawback, if it is required to provide sealing from above and below two cup seals are used, the cups facing in opposite directions.

SUMMARY OF THE INVENTION

According to a first aspect of the present invention there is provided a sealing apparatus for sealing an annulus, the apparatus comprising:

a first sealing element adapted for sealing the annulus against fluid pressure from above the sealing apparatus and adapted to be actuated by fluid pressure from above the apparatus; and a second sealing element adapted for sealing the annulus against fluid pressure from below the sealing apparatus and adapted to be actuated by fluid pressure from below the apparatus;

wherein the sealing elements are arranged such that the second sealing element is, in use, above the first sealing element.

It will be understood that the terms "above" and "below" are used to explain the relative positions of the sealing elements in a substantially vertical borehole. The invention can equally be used in inclined or horizontal wells in which case the second sealing element will be located uphole from the first sealing element.

In one embodiment, this arrangement provides a sealing apparatus which can seal from pressure applied from above, in which case the upper sealing element is substantially redundant and the lower sealing element is active, or from below, in which case the lower sealing element is substantially redundant and the upper sealing element is active. Arranging the sealing elements in this way, that is with the redundant sealing element located on the high pressure side of the active sealing element, is advantageous primarily because the force exerted on the sealing apparatus is only transmitted through one of the sealing elements as the redundant sealing element can be bypassed. This contrasts with the prior art, in which the active seal element is located before the redundant element, and the load applied to the active element has to be transmitted through the redundant element. In the prior art, heavy duty metal collars have to be provided to transmit this force. As the present sealing apparatus, in one embodiment, no longer requires the collars, more space is available either to increase the size of the apparatus throughbore or to increase the thickness of the sealing elements.

Preferably, the sealing elements are deformable.

Preferably, the sealing elements are cup-shaped.

Preferably, in use and when a pressure differential exists across the sealing apparatus, there is an active sealing element and a substantially redundant sealing element. By this it is meant the majority of the seal provided by the sealing apparatus is provided by one of the sealing elements, that is the active sealing element.

Preferably, the sealing elements are adapted to be mounted on a mandrel so as to define a volume between each sealing element and the mandrel Preferably, each sealing element comprises a base portion and a tip portion.

Preferably, the first and second sealing element tip portions are arranged facing one another.

Preferably, the first sealing element tip portion is engaged with a first side of a ring member.

Preferably, the second sealing element tip portion is engaged with a second side of the ring member.

Most preferably, the first and second sealing elements are sealed to the ring member.

Preferably, the first and second sealing elements are pinned to the ring member.

Alternatively, or additionally, the first and second sealing elements are adhered or clamped to the ring member.

Alternatively or additionally, the first and second sealing elements are attached to the ring member by any appropriate fixing means.

Preferably, the ring member defines an "H" section.

Preferably, the first sealing element base portion is attached to a first tubular.

Preferably, the second sealing element base portion is attached to a second tubular.

Preferably, when located in a conduit, the sealing apparatus defines the annulus with a conduit wall.

The conduit wall may be a cased bore, a lined bore or an open hole.

Preferably, the sealing apparatus is adapted to form an initial seal with a conduit wall through application of a setting force to the sealing elements.

Preferably, the setting force is a compression force.

The sealing apparatus may form an initial seal by buckling.

Preferably, an external surface of each sealing element defines an initial engagement portion adapted to sealingly engage a conduit wall upon application of the setting force.

Preferably, the initial engagement portion is a circumferential band around each sealing element.

Preferably, the initial engagement portion is between the tip portion and the base portion of each sealing element.

Most preferably, the initial engagement portion is spaced from the tip portion and the base portion of each sealing element.

Preferably, each sealing element defines a passage extending through the sealing element from the sealing element external surface to a sealing element internal surface. Provision of a passage permits fluid to pass through the sealing element.

Preferably, the end of the passage defined by the sealing element external surface is at least partially located between the tip portion and the initial engagement portion.

Alternatively, the end of the passage defined by the sealing element external surface is wholly located within the initial engagement portion.

In one embodiment, where the sealing apparatus is sealing against a high pressure fluid, the opening of the active sealing element passage is at least partially located on the high pressure side of the initial engagement portion. This arrangement permits fluid from the high pressure side of the active sealing element to enter the volume between the sealing elements and the mandrel. The pressurised fluid then presses on the internal surface of the active sealing element forcing the active sealing element into a tighter engagement with the conduit wall, improving the sealing effect of the sealing apparatus, that is, a further sealing effect is provided by hydraulic expansion. In the same embodiment, the high pressure fluid displaces the redundant sealing element sufficiently from the conduit wall to expose the opening of the redundant sealing element passage providing a further, or alternative, fluid path for the high pressure fluid into the volume between the sealing elements and the mandrel.

Preferably, there are a plurality of passages in each sealing element.

Preferably, the ring member defines a communication bore between the annulus and the volume to permit fluid in the annulus actuate at least one of the sealing elements.

Preferably, the ring member defines a plurality of communication bores.

Preferably, the communication bore defines a sand screen.

Preferably, the ring member is adapted to move with respect to the mandrel. This movement permits the initial set applied by the setting force to be transmitted from one end of the sealing apparatus through the ring member.

Alternatively, the ring member is fixed with respect to the mandrel. This arrangement permits the compression force to be applied to the sealing apparatus from both ends.

Preferably, the first and second sealing elements are resilient.

Most preferably, the sealing elements are elastomeric.

Preferably each sealing element comprises a relatively hard portion. This hard portion is preferably located towards the sealing element base portion. The presence of a relatively hard portion acts as an anti-extrusion device to prevent the flow of softer material which may otherwise occur when the sealing element is under pressure or exposed to high temperatures, which would compromise the seal.

The hard portion may be rubber, nitrile butadiene rubber, hydrogenated nitrile butadiene rubber, fluoroelastomer, perfluoroelastomer, or tetrafluoroethylene/propylene copolymers or the like.

Preferably, the sealing element and the hard portion share an interface.

Preferably, the sealing element and the hard portion are bonded together at the interface.

Preferably, the bond extends along only part of the interface.

Each sealing element may in addition, or instead, comprise an annular spring member embedded within the sealing element. The spring may be a garter spring or the like. The spring may comprise a relatively hard core within the spring; this also serves as an anti-extrusion device. In certain embodiments, the spring may be a dual spring; that is, a spring embedded within an outer spring. The spring itself has the additional function of improving resilience of the sealing element and assisting its return to the non-expanded state.

The spring may be a single spring or multiple springs.

Each sealing element may in addition, or instead, comprise a seal back up in the form of a metallic band around the circumference of the sealing element.

Preferably, the metal band defines a plurality of fingers or petals which spread as the sealing element expands.

Preferably, there are two metal bands defining fingers or petals, the bands arranged such that when the sealing element is expanded the petals of one band cover the gaps between the petals in the other band. Seal back ups of this type are especially useful when the elastomeric sealing element is made from a soft elastomer. Soft materials extrude more easily then harder materials and a petal seal back up helps prevent extrusion. Seal back ups of this type can also be used where the sealing apparatus has to expand over a larger distance to make a seal with a conduit wall, for example when sealing in open hole.

Alternatively, each sealing element may comprise a plurality of individual petals.

Where the petals are used with a relatively hard material, the petals may be bonded to the hard material.

Preferably, each sealing element is of tapered form.

Preferably, each element is axially tapered.

Preferably, each element is axially tapered towards the element tip portion.

Preferably, the external surface of each sealing element is generally flat, while the internal surface is generally tapered away from the mandrel. A flat outer surface allows for a greater area of contact between the sealing element and the conduit wall.

Preferably, a deformation device is provided to apply a force to an internal surface of the sealing elements to provide an initial deformation of the sealing elements towards, in use, a conduit wall.

Preferably, the force is a radial force.

In one embodiment the deformation device is radially fixed.

In an alternative embodiment the deformation device is radially movable between a run-in position and a radially expanded position.

Preferably, the deformation device is a profiled portion.

Preferably, the profiled portion is defined by the ring member.

Alternatively, the deformation device is a radially deformable sleeve.

According to a second aspect of the present invention there is provided a sealing apparatus for sealing a conduit, the sealing apparatus comprising:

a deformable sealing element adapted for selectively sealing the conduit against pressure from a first side, the sealing element being adapted to be mounted on a mandrel so as to define a volume between the sealing element and the mandrel;

wherein the sealing element defines a passage extending between the volume and an exterior portion of the tool, the passage adapted to permit fluid from a second side of the element to enter the volume.

A sealing apparatus according to an embodiment of the invention permits fluid in the conduit, applying pressure on the side of the sealing element opposite the side which it is desired to provide a seal to move past the sealing element. This ensures the sealing element does not rupture if, for example, the pressure rises in a body of fluid trapped between a pair of sealing apparatus arranged to seal from opposite directions. The trapped fluid can simply move past one or both of the sealing elements.

Preferably, the/each passage is adapted to permit fluid from the first side of the packing tool to enter the volume and cause further deformation of the sealing element.

According to a third aspect of the present invention there is provided a sealing apparatus for sealing an annulus, the sealing apparatus comprising:

a first sealing element for, in use, sealing the annulus against pressure from above the sealing apparatus; and a second sealing element for, in use, sealing the annulus against pressure from below the sealing apparatus;

wherein the sealing elements are arranged such that the second sealing element is, in use, above the first sealing element.

According to a fourth aspect of the present invention there is provided a sealing apparatus for sealing a conduit, the sealing apparatus comprising:

a deformable sealing element adapted for selectively sealing the conduit, and a seal back up for preventing extrusion under pressure of the sealing element, the seal back up comprising a sleeve of relatively hard material, the sleeve extending partially along an outer surface of the sealing element, and at least one support band mounted to an external surface of the sleeve.

Provision of a seal back up incorporating a relatively hard material and at least one support band permits the use of the apparatus in higher temperature environments because the seal back up will prevent extrusion of the sealing element. The arrangement also allows for the use of a soft elastomer to be used for the sealing element, allowing for greater expansion.

Preferably, there are a pair of overlapping support bands, each band defining a plurality of petals.

Preferably, the/each band is metal.

It will be understood that the features of one aspect may be equally applicable to the other aspects and have not been repeated for brevity.

DETAILED DESCRIPTION OF THE DRAWINGS

Figure 1:
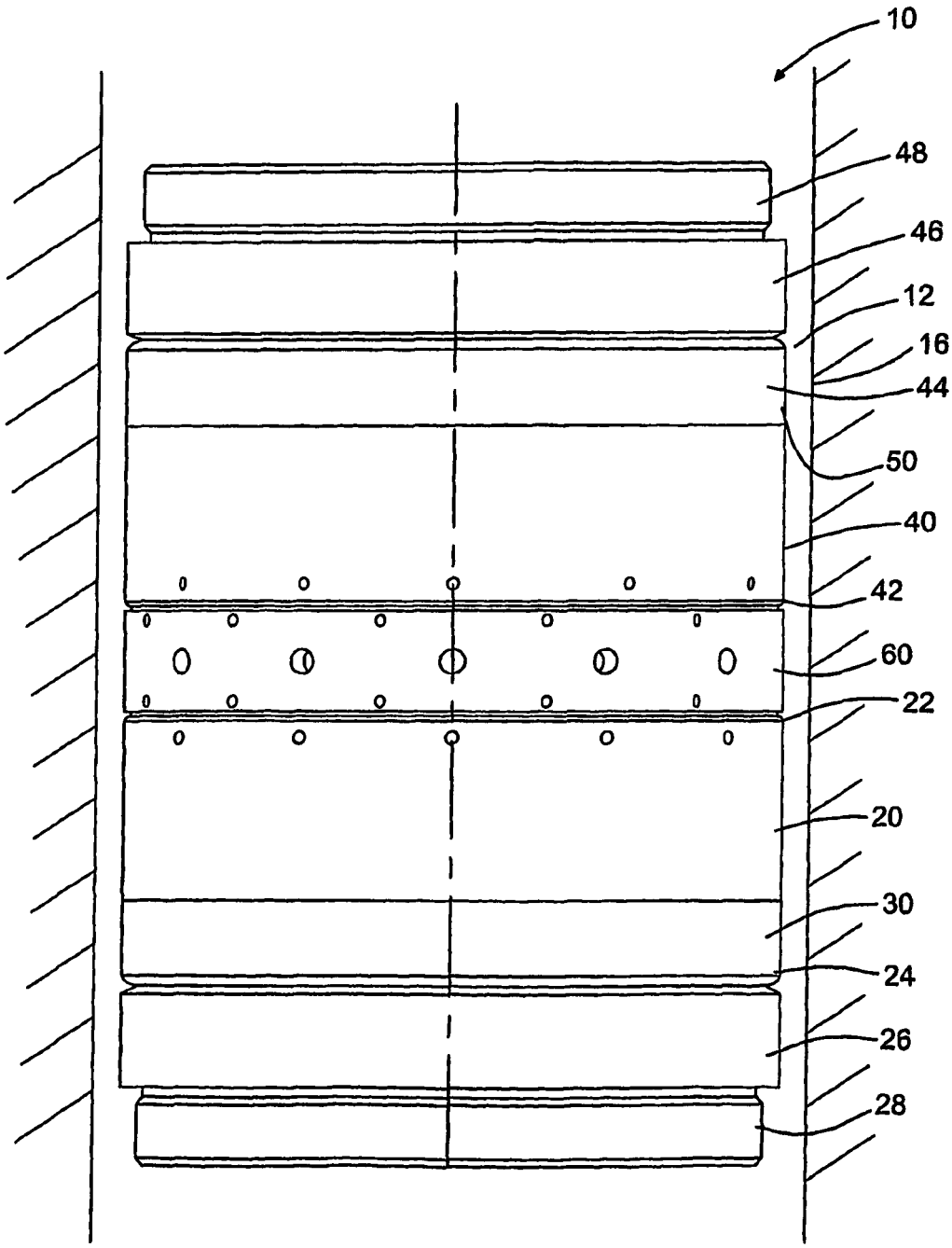
FIG. 1 is a side view of a sealing apparatus according to a first embodiment of the present invention.

Referring firstly to FIG. 1 there is shown a side view of a sealing apparatus generally indicated by reference numeral 10 for sealing an annulus 12 between the sealing apparatus 10 and a conduit wall 16, in the form of a cased bore, according to a first embodiment of the present invention.

The sealing apparatus 10 comprises a first elastomeric seal element 20 for sealing the annulus 12 against fluid pressure from above the sealing apparatus 10, and adapted to be actuated by fluid pressure from above the apparatus 10. The sealing apparatus 10 further comprises a second elastomeric sealing element 40 adapted for sealing the annulus 12 against fluid pressure from below the sealing apparatus 10 and adapted to be actuated by fluid pressure from below the apparatus 10. As can be seen from FIG. 1, the sealing elements 20,40 are arranged such that the second sealing element 40 is, in use, above the first sealing element 20.

Figure 2:
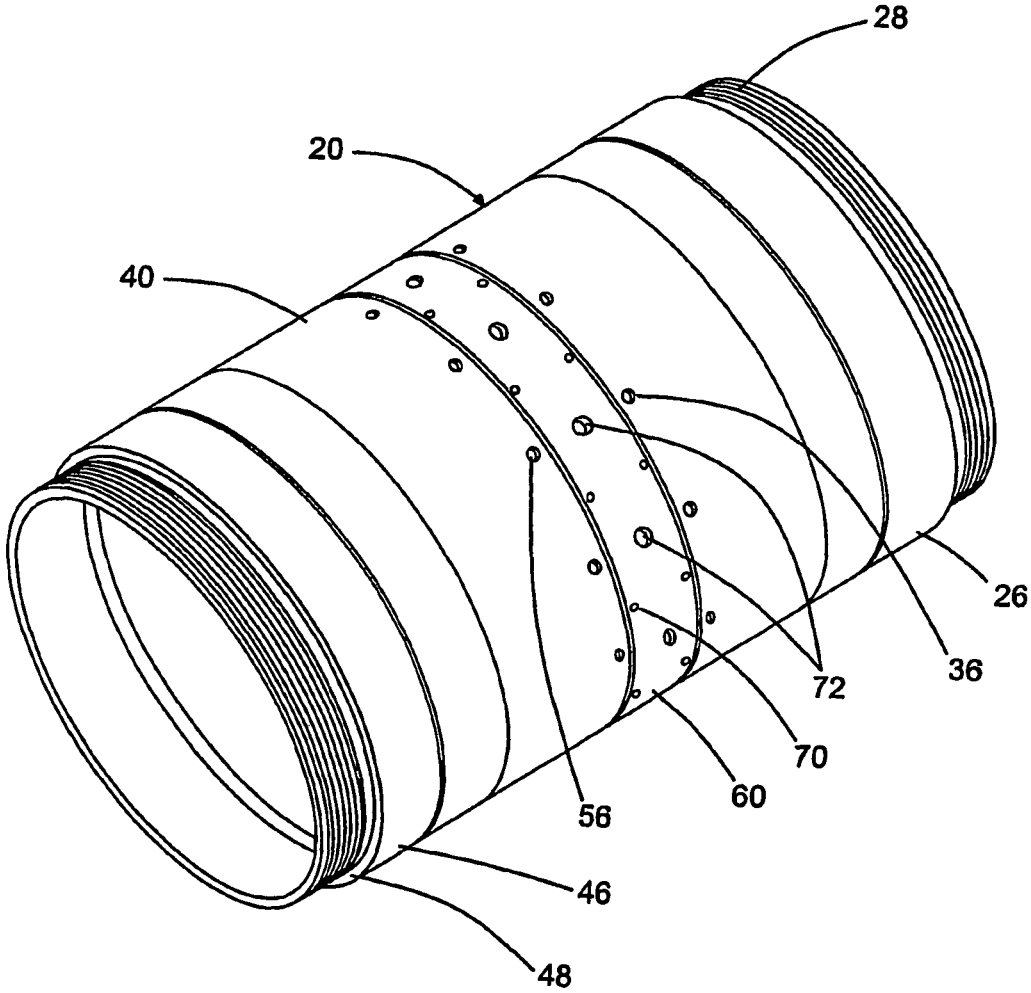
FIG. 2 is a perspective view of the sealing apparatus of FIG. 1.

The first sealing element 20 comprises a tip portion 22 and a base portion 24. The tip portion 22 is attached to a ring member 60 which will be described in due course. The base portion 24 is attached to a first seal element collar 26 which includes a threaded portion 28, most clearly seen in FIG. 2, a perspective view of the sealing apparatus 10 of FIG. 1 and adapted to be connected to a tool or a tubular (not shown).

Referring back to FIG. 1, the second seal element 40 also comprises a tip portion 42, and a base portion 44, the tip portion 42 being attached to the ring collar member 60 and the base portion 44 being attached to a second seal element collar 46 which also comprises a threaded portion 48 (again most clearly seen on FIG. 2) for securing the sealing apparatus 10 to a tool or a tubular.

As can be seen from FIG. 1, the sealing element tip portions 22,42 are arranged so that they are facing each other.

The first and second seal elements 20,40 also comprise seal back-ups 30,50 which will be described with reference to FIG. 3, a longitudinal section view of the sealing apparatus 10 of FIG. 1.

Figure 3:
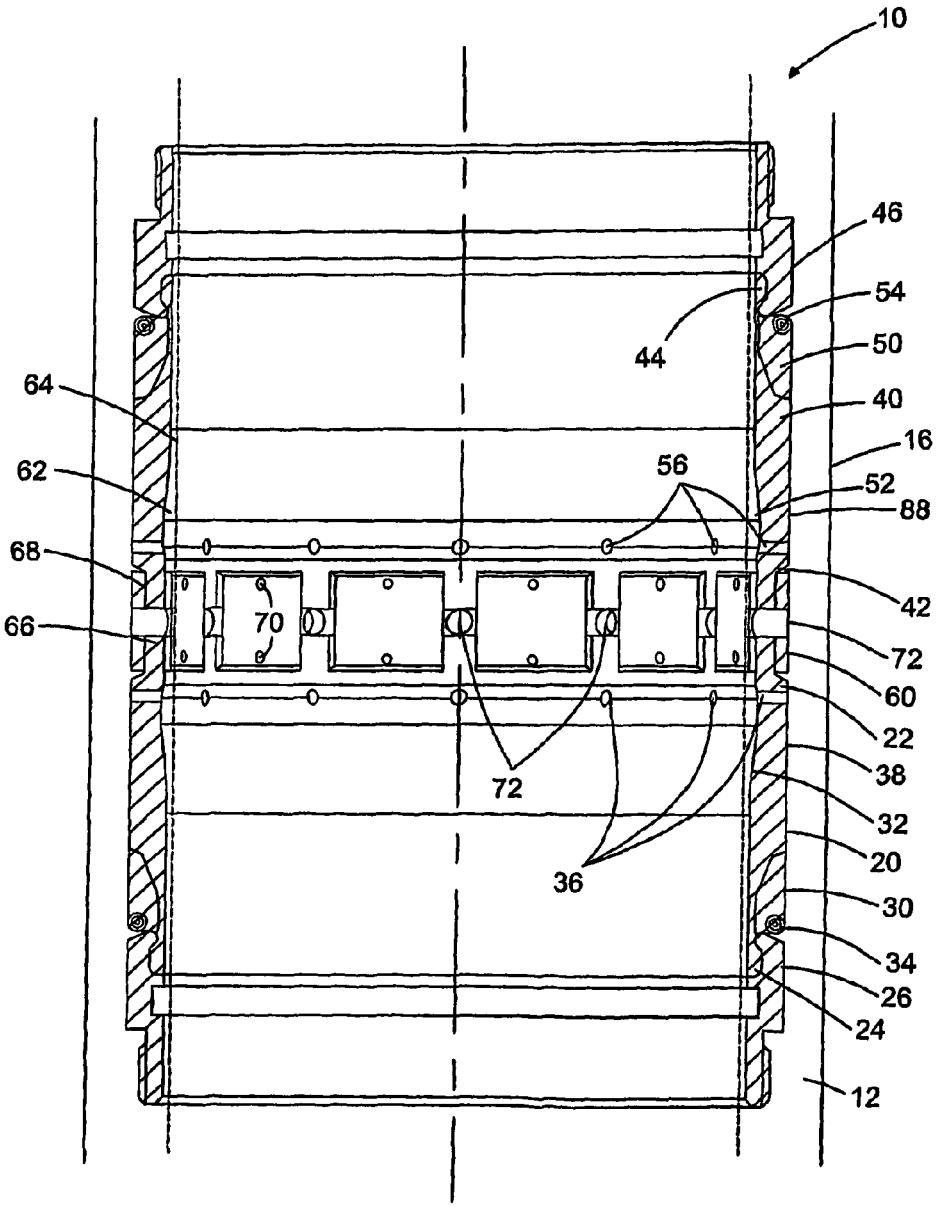
FIG. 3 is a longitudinal section view of the sealing apparatus of FIG. 1.

As can be seen from FIG. 3, each seal element 20,40 is cup shaped and includes a tapered portion 32,52 adjacent the respective tips 22,42 of the first and second sealing elements 20,40. When the elastomeric seal elements 20,40 are exposed to pressure there may be a tendency for the elastomeric material to flow hence the provision of the seal back-ups 30,50. The seal back-ups 30,50 are made of a hard rubber and are biased to the position shown in FIG. 1 by a first element garter spring 34 and a second element garter spring 54 respectively.

As can be seen from FIG. 3, the first seal element 20 comprises a number of first seal element passages 36 which extend from the external surface 38 of the first seal element 20 to an internal volume 62 defined by the internal surfaces of the sealing apparatus 10 and a mandrel 64, shown in broken outline for clarity. The mandrel 64 extends through the sealing apparatus 10 and may be used to, for example, transfer hydrocarbons from downhole to surface.

The second sealing element 40 also includes a plurality of passages 56 extending from the external surface 58 of the second seal element 40 to the volume 62. The purpose of the passages 36,56 will be discussed in due course.

The ring member 60 describes an H section, and defines a first and a second recess 66,68 which receive the first element tip portion 22 and the second element tip portion 42 respectively. The first and second tip portions 22,42 are secured to the ring member 60 by a series of spiral pins 70 which run around the circumference of the ring member 60.

The ring member 60 also defines a plurality of communication bores 72 providing communication between the annulus 12 and the internal volume 62.

The setting and sealing capabilities of the sealing apparatus 10 will now be described with reference to FIG. 4, a half longitudinal section view of the sealing apparatus 10 shown partially set in an annulus 12, and FIG. 5, a half longitudinal view of the sealing apparatus 10 of FIG. 1 shown fully set in the annulus 12.

Figure 4:
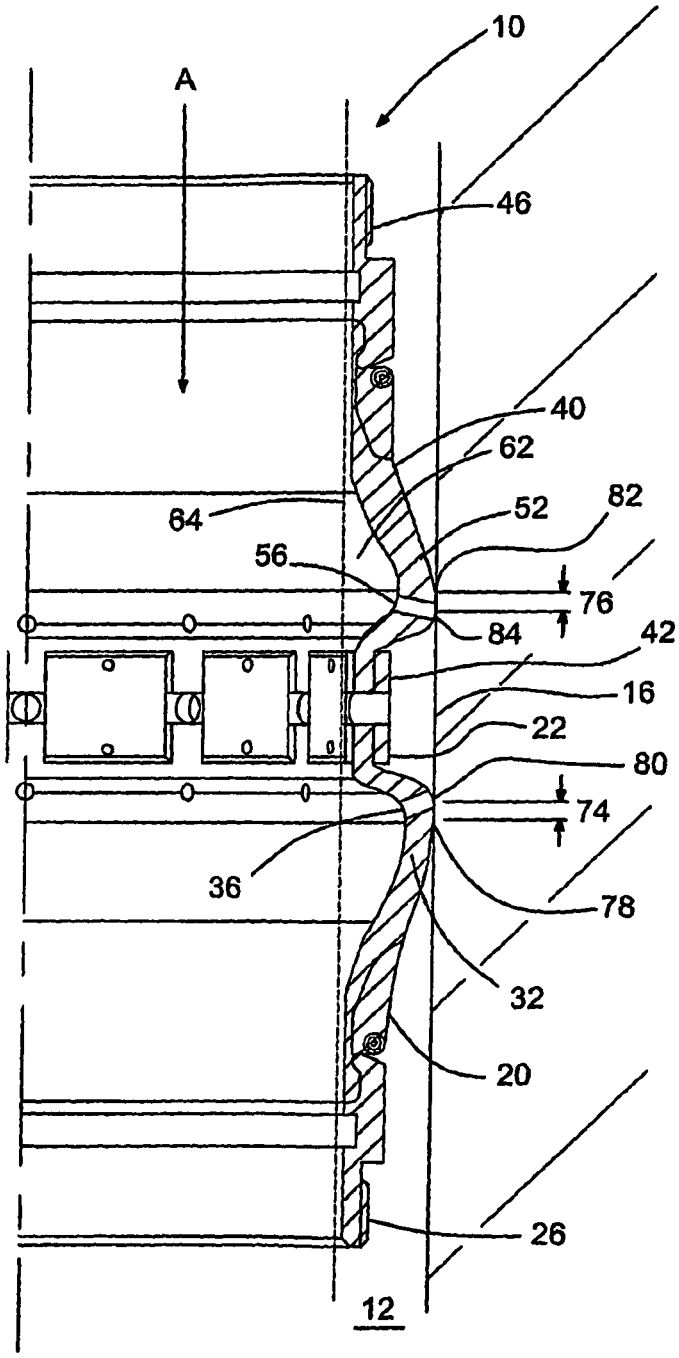
FIG. 4 is a half longitudinal section view of the sealing apparatus of FIG. 1 shown partially set in a conduit.

As can be seen from FIG. 4 in the partially set configuration the tapered portions 32,52 of the first and second seal elements 20,40 have buckled radially outwardly into contact with the conduit wall 16. The external surface of each of said first and second seal elements 20,40 defining an initial engagement portion adapted to engage the conduit wall upon application of the setting force. This buckling is caused by the application of a compression force in the direction of arrow A in which the second element collar 46 axially translates towards the first element collar 26 which remains stationary.

The initial engagement portions comprising a first seal element initial engagement band 74 and a second seal element initial engagement band 76. The first seal element initial engagement band 74 engages the conduit wall as does the second seal element initial engagement band 76. As can be seen in both cases, the seal element passages 36,56 straddle the edge of the initial engagement bands 74,76 such that the first element passage 36 has a portion 78 which lies within the initial engagement band 74 and a further portion 80 which lies between the initial engagement band 74 and the element tip 22. Similarly each second element passage 56 has a portion 82 which lies within the initial engagement band 76 and a portion 84 which lies between the initial engagement band 76 and the element tip 42.

Figure 5:
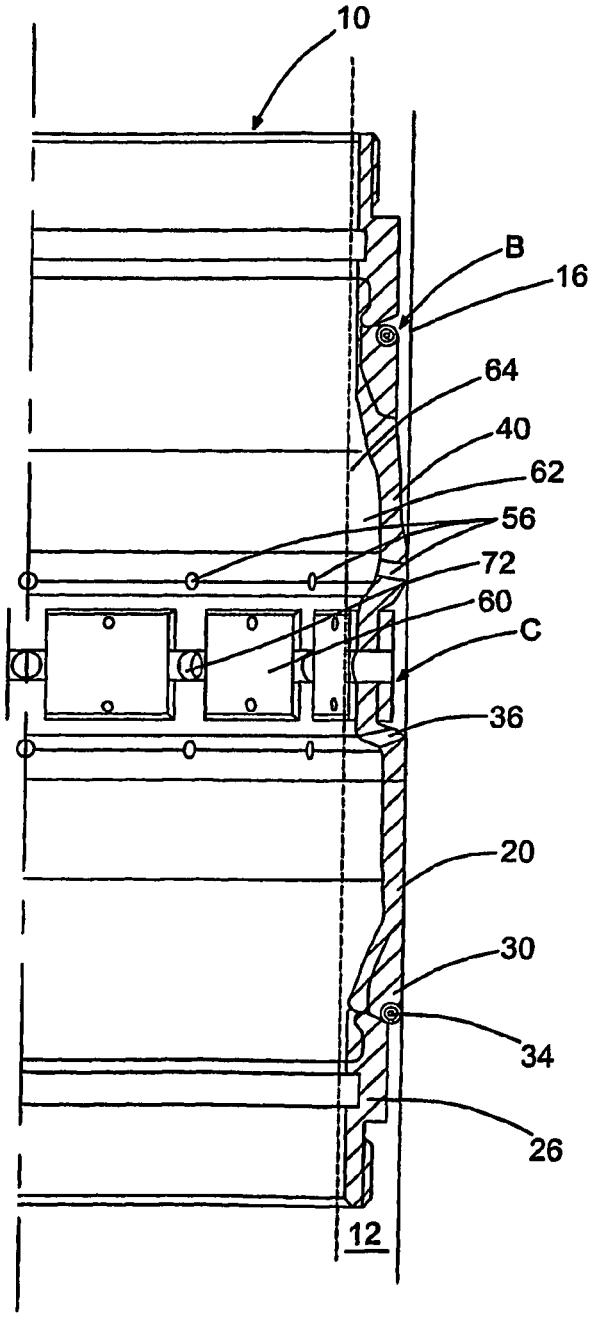
FIG. 5 is a half longitudinal section view of the sealing apparatus of FIG. 1 shown fully set in the conduit.

Referring now to FIG. 5, an increased pressure is applied to the sealing apparatus 10 from above the apparatus 10, that is, in the portion of the annulus indicated by letter "B". In this case, the first seal element 20 is what is termed the active seal element, that is, it is sealing the annulus 12 such that the pressure in section B of the annulus 12 does not pass the sealing apparatus 10. The second sealing element 40, that is provided to seal against pressure from the opposite direction, in this case, is termed the redundant sealing element. As the pressure builds up in annulus section B, the second element 40 deflects inwardly and the engagement band 76 translates axially down the conduit wall 16 to expose the second element passages 56. In doing so, the area of the external surface of the second sealing element 40 in engagement with the conduit wall 16 increases. Once the passages 56 are exposed, pressurised fluid can flow through the passages 56 into the interior volume 62. When this happens the pressure equalises across the second element 40 but builds up against the internal surface of the first sealing element 20. This forces the first sealing element 20 outwards into a tighter engagement with the conduit wall 16. In doing so, the area of the external surface of the first sealing element 20 in engagement with the conduit wall 16 increases.

As can be seen from FIG. 5 the first sealing element seal back-up 30 moves radially outwardly to lie against the conduit wall 16 and to prevent extrusion of the elastomeric sealing element 20 downhole between the first element collar 26 and the conduit wall 16. In this position the steel garter spring 34 has also moved radially outwards to block the annulus 12

If the pressure in the annulus section B is sufficiently high pressurised fluid may seep down the annulus 12 passed the initial engagement band 76 of the second seal element 40 and into an annulus portion C defined between the conduit wall 16 and the ring member 60. Pressurised fluid can then flow through the communication bores 72 into the interior volume 62. Alternatively pressurised fluid which has flowed into the interior volume 62 through the second element passages 56 can flow through out of the communication bore 72 into the annulus section C until the pressure is equalised.

If the pressure in the annulus B is removed, the sealing apparatus will return to the configuration shown in FIG. 4, the garter spring 54 returning the seal back-up 50 to the position shown in FIG. 4. Then if the sealing apparatus 10 is exposed to a higher pressure from a downhole location, the apparatus 10 will adopt a configuration opposite to the configuration shown in FIG. 5.

Figure 6:
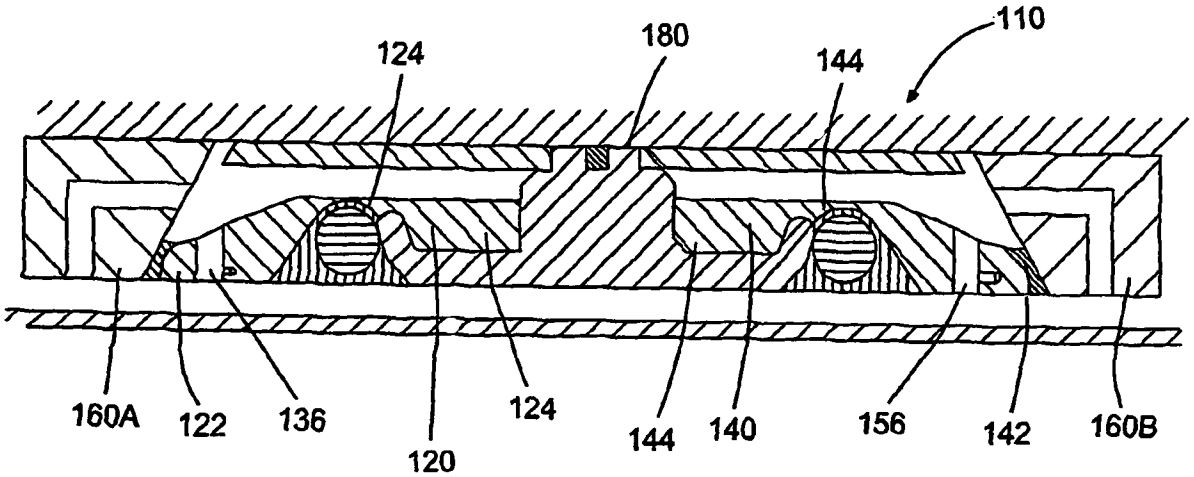
FIG. 6 is a half longitudinal section view of part of a sealing apparatus in a conduit in a run-in configuration according to a second embodiment of the present invention.

Reference is now made to FIG. 6, a half longitudinal section view of a part of a sealing apparatus 110 in a conduit shown in a run-in configuration according to a second embodiment of the present invention. Features in common between the sealing apparatus 110 of the second embodiment and the sealing apparatus 10 of the first embodiment are given the same reference numeral in the second embodiment incremented by 100.

The sealing apparatus 110 comprises a first sealing element 120 and a second sealing element 140. The first sealing element 120 comprises a tip portion 122 and a base portion 124. Similarly the second sealing element 140 also comprises a tip portion 142 and a base portion 144. It will be noted in this embodiment, the tip portions 122,142 are at opposite ends of the sealing apparatus 110 rather than adjacent as they were in the sealing apparatus 10 of the first embodiment.

The base portions 124,144 are adhered to a central collar 180, and the tip portions 122,142 are adhered to first and second ring members 160*a*,160*b* respectively by an adhesive layer 181*a*,181*b* respectively.

The first and second sealing elements each define a plurality of passages 136,156 respectively, the purpose of which will now be described.

Figure 7:
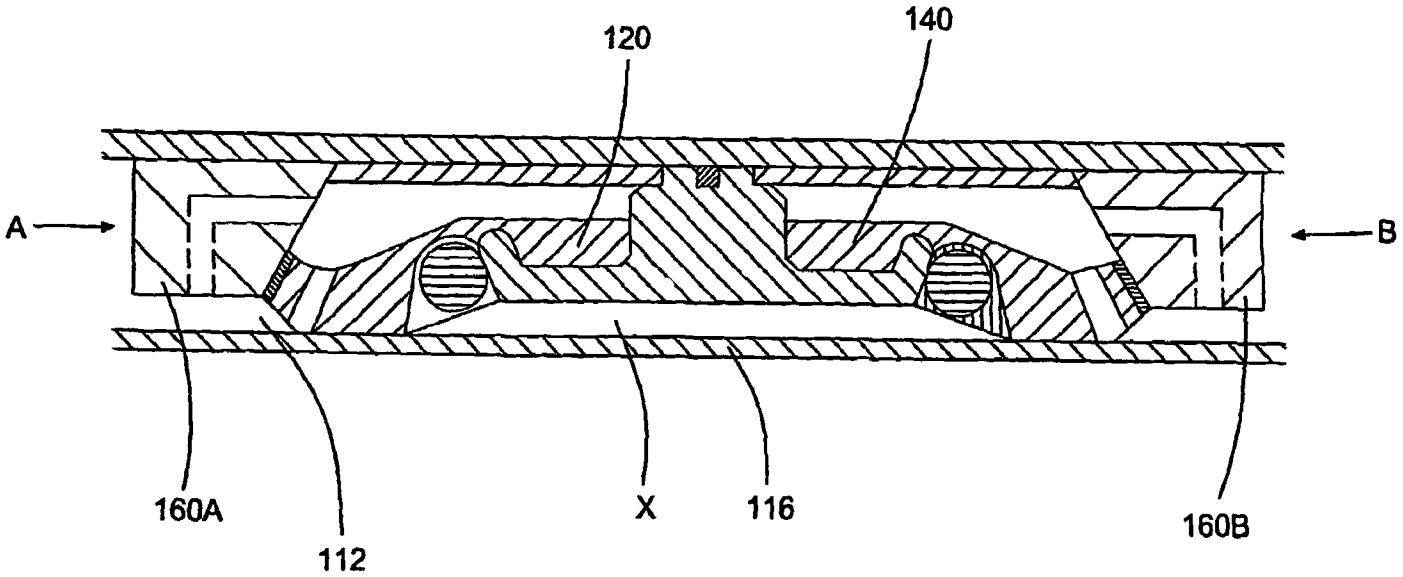
FIG. 7 is a half longitudinal section view of part of the apparatus of FIG. 6 shown partially set in the conduit.

Referring to FIG. 7, a half longitudinal section view of the sealing apparatus 110 of FIG. 6 shown in a partially set configuration, the sealing elements 120,140 have formed a seal with a cased bore wall 116 to seal an annulus 112. This initial engagement of the sealing elements 120,140 with the bore wall 116 is achieved by the axial translation of the first ring member 160*a* in the direction of arrow "A" and the axial translation of the second ring member 160*b* in the direction of arrow "B".

With the sealing element 120,140 in the partially set configuration, a volume of fluid is trapped in a section "X" of the annulus 112.

Figure 8:
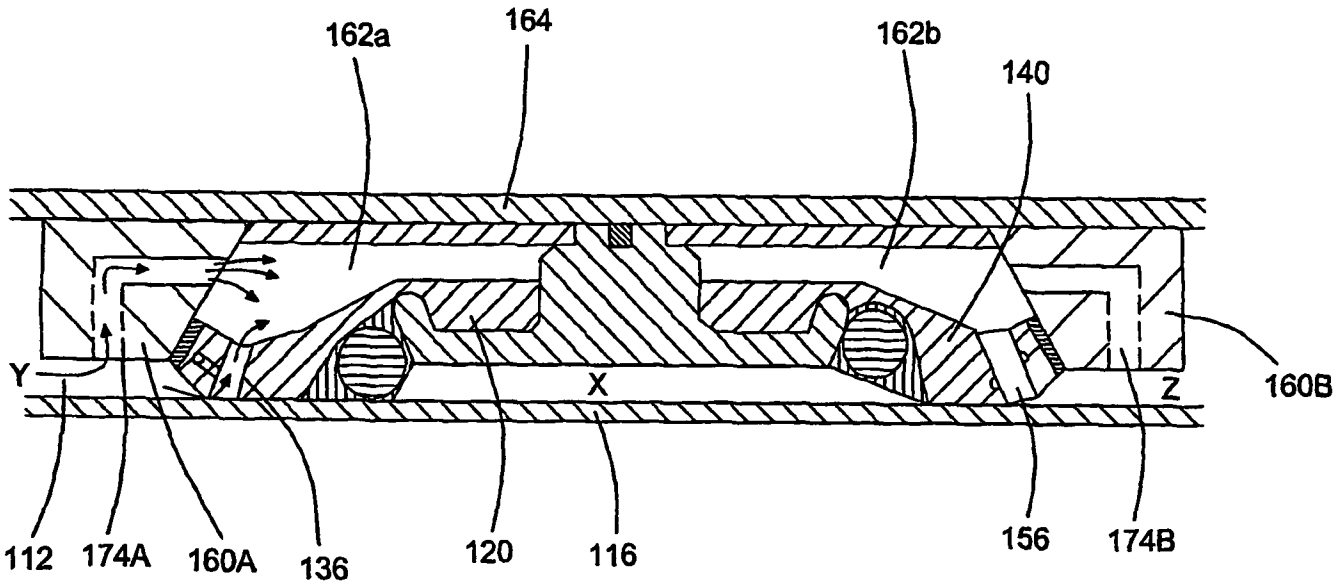
FIG. 8 is a half longitudinal section view of part of the apparatus of FIG. 6 shown fully set in the conduit.

Referring now to FIG. 8, a half longitudinal section view of the sealing apparatus 110 of FIG. 6 shown in a fully set configuration. In this Figure, the sealing apparatus 110 is exposed to a high pressure fluid in a section "Y" of the annulus 112. The fluid flows through a ring member communication bore 174*a* and through the first sealing element passages 136 into a volume 162*a* defined by a mandrel 164 and the first sealing element 120. This high pressure fluid then presses the sealing element 120 into a tighter engagement with the conduit wall 116, fully sealing the annulus 112 from the high pressure fluid.

By this action, however, the volume of annulus section X is decreased, increasing the pressure on the fluid trapped in the annulus section X. The provision of the second element passages 156, however, means that if the pressure of the trapped fluid increases sufficiently, the fluid can move the second sealing element 140 away from the conduit wall 116 and the trapped fluid pressure can be relieved by fluid escaping through the sealing element passages 156 and into a volume 162*b*. The volume 162*b* is pressure balanced with a low pressure section "Z" of the annulus by a ring member communicating bore 174*b*. Provision of the passages 156 therefore prevents the pressure in annulus section X increasing sufficiently to damage the sealing apparatus 110, and particularly the second sealing element 140.

Figure 9:
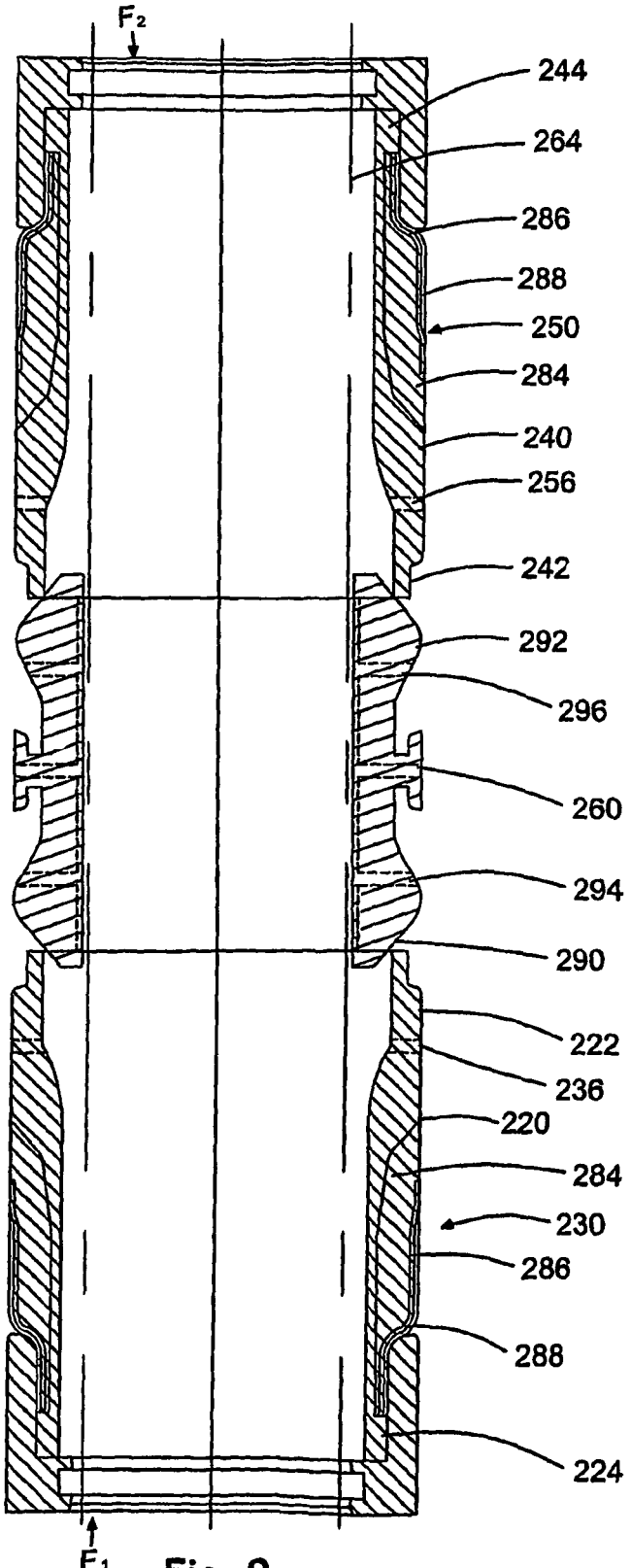
FIG. 9 is a longitudinal section view of a sealing apparatus according to a third embodiment of the present invention.

Reference is now made to FIG. 9, a longitudinal section view of a sealing apparatus 210 according to a third embodiment of the present invention. The sealing apparatus 210 is similar to the sealing apparatus 10 of the first embodiment and features in common between the sealing apparatus 210 of the third embodiment and the sealing apparatus 10 of the first embodiment are given the same reference numeral in the third embodiment incremented by 200.

The sealing apparatus 210 comprises a first sealing element 220, a second sealing element 240 and a ring member 260. Each sealing element 220,240 comprises a tip portion 222, 242 and a base portion 224, 244.

The first and second sealing elements 220,240 also comprise seal back ups 230,250. The seal back ups 230,250 both comprise a sleeve of hard rubber 284, an inner support layer 286 and an outer support layer 288. The inner and outer support layers 286,288 are in the form of a band of metal petals, the layers 286,288 being arranged to permit the sealing elements 220,240 to expand radially outwards. As the sealing elements 220,240 expand, the petals open up and the layers 286,288 overlap such that gaps between petals of the inner layer 286 are covered by the petals of the outer layer 288 and vice versa.

The provision of back up systems 230, 250 with inner and outer support layers of metal petals 286,288 means a weaker elastomer can be used for the sealing elements 220,240 which permits greater expansion of the sealing elements 220,240 to bridge larger annuluses, which might be encountered, for example, in an open hole. Similarly, the provision of such back up systems 230,250 are of benefit in high temperature environments where the sealing elements 220,240 may soften and be inclined to extrude under pressure into the annulus (not shown). The metal layers 286,288 provide support for the sealing elements 220,240 to prevent extrusion.

The ring member 260 defines a first sealing element deforming portion 290 and a second sealing element deforming portion 292. These portions 290,292 assist in the initial deformation of the sealing elements 220,240 when a larger annulus has to be bridged. In the sealing apparatus 210 of FIG. 9, the ring member is fixed axially with respect to the mandrel 264, shown in broken outline. To set the sealing apparatus 210, a compressive force is applied to each end of the sealing apparatus 210 in the directions of arrows $F_1$ and $F_2$.

Figure 10:
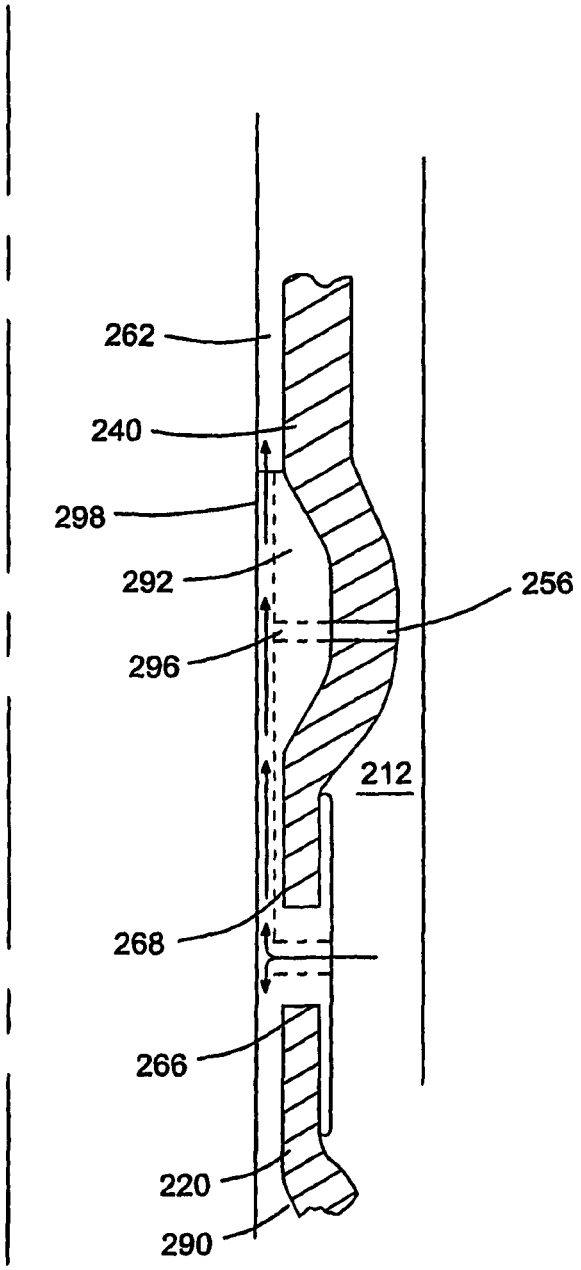
FIG. 10 is an enlarged close up view of part of the sealing apparatus of FIG. 9.

Referring to FIG. 10, an enlarged close up of part of the sealing apparatus 210 of FIG. 9, under the action of the forces $F_1$ and $F_2$, the sealing elements 220,240 slide over the ring member portions 290,292 and the sealing element tip portions 222,242 engage, and are contained within, the ring member recesses 266,268 respectively.

As will be noted from FIG. 9, the ring member portions 290,292 define passages 294,296 respectively. In the position shown in FIG. 10, these passages line up with the sealing element passages 236,256 (only shown on FIG. 10 for the second sealing element 240) to permit fluid to flow from the annulus 212 into the volume 262 behind the sealing elements 220,240 via a ring member channel 298

Figure 11:
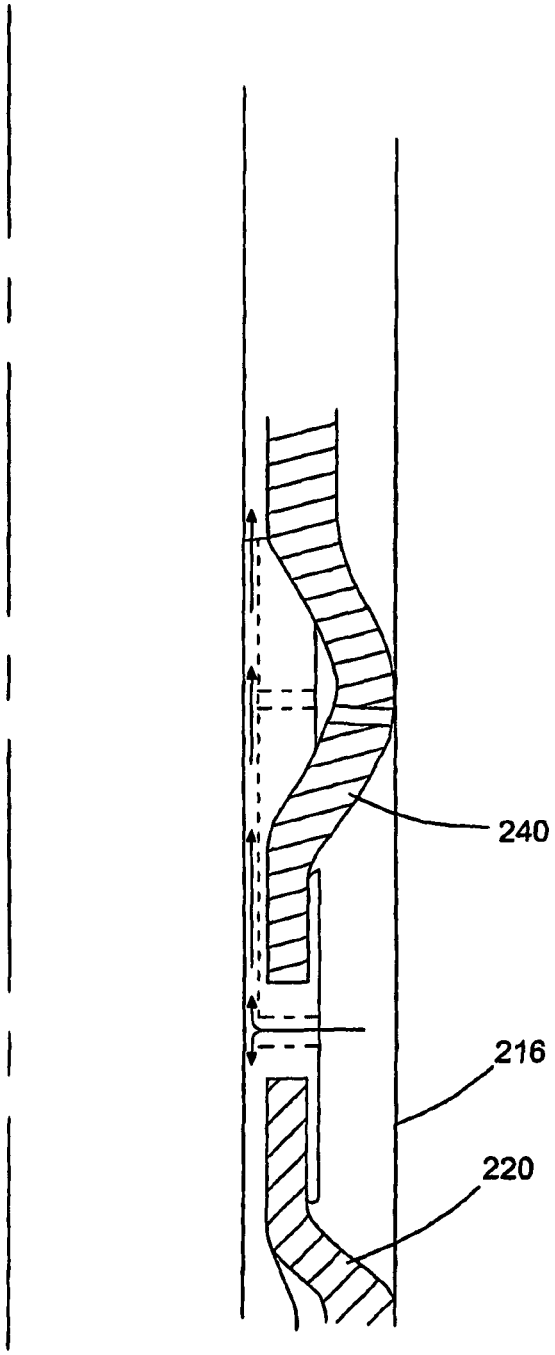
FIG. 11 is an enlarged close up view of part of the sealing apparatus of FIG. 9.

Referring now to FIG. 11, an enlarged close up of part of the sealing apparatus 210 of FIG. 9, continued application of the forces $F_1$ and $F_2$ deforms the sealing elements 220,240 into engagement with the conduit wall 216 to form the initial seal.

Figure 12:
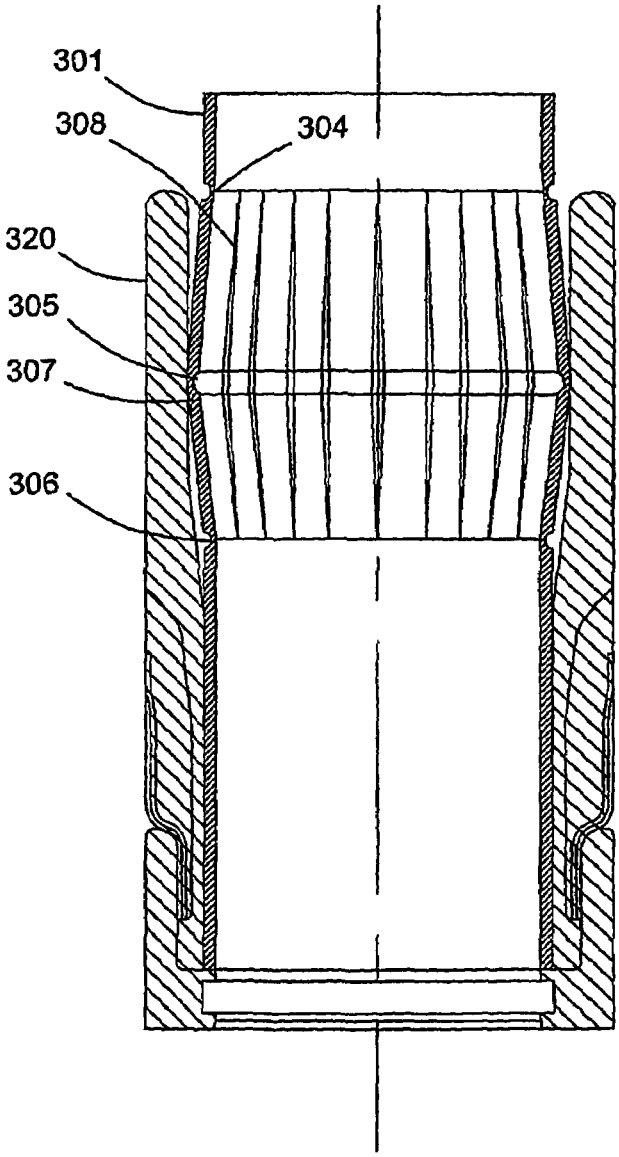
FIG. 12 is a longitudinal section view of part of a sealing apparatus in accordance with a fourth embodiment of the present invention.

An alternative method of providing an initial deformation of the sealing elements 220,240 of FIG. 9 is shown in FIG. 12, a longitudinal section view of part of a sealing apparatus 310 in accordance with a fourth embodiment of the present invention.

In this Figure only one sealing element 320 is shown. A single sealing element arrangement could be used to seal from only one direction or another sealing element could be added to seal from the opposite direction to the first sealing element 320 as well.

In this embodiment, a collapsible sleeve 301 is provided behind the sealing element 320. The sleeve 301 comprises a cylindrical tubular defining a plurality of slots 303. The sleeve 301 also includes three circumferential grooves 304,305,306. The grooves 304,305,306 are points of weakness of the sleeve 301, and the application of a compressive force will cause the sleeve 301 to deform at these points of weakness 304,305,306 resulting in a sleeve centre portion 307 bowing radially outwards to deform the sealing element 320.

Various modifications can be made to the described embodiments without departing from the scope of the invention. For example, the ring member 60 is described as an H section, it will be understood that any suitable section could be used. Similarly although the collars 26,46 have threaded portions 28,48 for attaching to tools or tubulars, collars could be attached to tools or tubulars by any suitable means, such as being pinned.

With regard to FIG. 12, although one sleeve 301 is used to deform the sealing element 320, a pair of overlapping sleeves could be used, one sleeve covering the gaps which are revealed due to opening of the slots 303 as the sleeve compresses.

The invention claimed is:

1. A sealing apparatus for sealing an annulus, the apparatus comprising:

a first sealing element adapted for sealing the annulus against fluid pressure from above the sealing apparatus and adapted to be actuated by fluid pressure from above the apparatus; and a second sealing element adapted for sealing the annulus against fluid pressure from below the sealing apparatus and adapted to be actuated by fluid pressure from below the apparatus; and arranged, in use, above the first sealing element;

wherein said first and second sealing elements have a partially set configuration and a fully set configuration, wherein said first and second sealing elements each comprise a first portion and a second portion;

wherein in said partially set configuration the first portion of at least one of said first and second sealing elements is adapted to form initial engagement to seal said annulus through application of a setting force to said sealing element, and wherein in said partially set configuration the second portion of said sealing element does not seal said annulus, and wherein in said fully set configuration fluid pressure from above or below the apparatus presses on an internal surface of said sealing element and causes hydraulic expansion of said sealing element to thereby seal said annulus with said second portion of said sealing element.

2. The sealing apparatus of claim 1, wherein the sealing elements are cup-shaped.

3. The sealing apparatus of claim 1, wherein, in use and when a pressure differential exists across the sealing apparatus, there is an active sealing element and a substantially redundant sealing element.

4. The sealing apparatus of claim 1, wherein the sealing elements are adapted to be mounted on a mandrel so as to define a volume between each sealing element and the mandrel.

5. The sealing apparatus of claim 4, wherein each sealing element defines a passage extending between the volume and an exterior portion of a packing tool, the passage adapted to permit fluid to enter the volume and cause further deformation of the sealing element.

6. The sealing apparatus of claim 1, wherein each sealing element comprises a base portion and a tip portion.

7. The sealing apparatus of claim 6, wherein the first and second sealing element tip portions are arranged facing one another.

8. The sealing apparatus of claim 7, wherein each sealing element comprises a relatively hard portion towards the base portion thereof.

9. The sealing apparatus of claim 8, wherein the sealing element and the hard portion share an interface.

10. The sealing apparatus of claim 9, wherein the sealing element and the hard portion are bonded together at the interface.

11. The sealing apparatus of claim 10, wherein the bond extends along only part of the interface.

12. The sealing apparatus of claim 8, wherein the apparatus is adapted for fluid pressure from above or below the apparatus to press on an internal surface of one of the first sealing element or the second sealing element and radial expansion of a said relatively hard portion into engagement with a conduit wall defining the annulus.

13. The sealing apparatus of claim 6, wherein the first sealing element tip portion is engaged with a first side of a ring member.

14. The sealing apparatus of claim 13, wherein the second sealing element tip portion is engaged with a second side of the ring member.

15. The sealing apparatus of claim 14, wherein the first and second sealing elements are sealed to the ring member.

16. The sealing apparatus of claim 14, wherein the first and second sealing elements are pinned to the ring member.

17. The sealing apparatus of claim 14, wherein the first and second sealing elements are adhered or clamped to the ring member.

18. The sealing apparatus of claim 13, wherein the ring member defines an "H" section.

19. The sealing apparatus of claim 13, wherein the ring member defines a communication bore between the annulus and the volume to permit fluid in the annulus actuate at least one of the sealing elements.

20. The sealing apparatus of claim 19, wherein the ring member defines a plurality of communication bores.

21. The sealing apparatus of claim 19, wherein the communication bore(s) defines a sand screen.

22. The sealing apparatus of claim 13, wherein the sealing elements are adapted to be mounted on a mandrel, wherein the ring member is adapted to move with respect to the mandrel, and wherein this movement permits the initial set applied by the setting force to be transmitted from one end of the sealing apparatus through the ring member.

23. The sealing apparatus of claim 13, wherein the sealing elements are adapted to be mounted on a mandrel, and wherein the ring member is fixed with respect to the mandrel, wherein this arrangement permits the compression force to be applied to the sealing apparatus from both ends.

24. The sealing apparatus of claim 6, wherein the first sealing element base portion is attached to a first tubular.

25. The sealing apparatus of claim 6, wherein the second sealing element base portion is attached to a second tubular.

26. The sealing apparatus of claim 1, wherein when located in a conduit, the sealing apparatus defines the annulus with a conduit wall.

27. The sealing apparatus of claim 1, wherein the setting force is a compression force.

28. The sealing apparatus of claim 1, wherein in said partially set configuration, an external surface of said sealing element defines an initial engagement portion adapted to engage a conduit wall upon application of the setting force; and wherein in said fully set configuration the area of the external surface of said sealing element in engagement with the conduit wall increases under the influence of fluid pressure on an internal surface of the said sealing element.

29. The sealing apparatus of claim 28, wherein the initial engagement portion is a circumferential band around each sealing element.

30. The sealing apparatus of claim 28, wherein each sealing element comprises a base portion and a tip portion and wherein the initial engagement portion is between the tip portion and the base portion of each sealing element.

31. The sealing apparatus of claim 30, wherein the initial engagement portion is spaced from the tip portion and the base portion of each sealing element.

32. The sealing apparatus of claim 1, wherein each sealing element defines a passage extending through the sealing element from a sealing element external surface to a sealing element internal surface.

33. The sealing apparatus of claim 32, wherein an external surface of each sealing element defines an initial engagement portion adapted to engage a conduit wall upon application of the setting force, wherein each sealing element comprises a base portion and a tip portion, wherein the initial engagement portion is between the tip portion and the base portion of each sealing element, wherein the end of the passage defined by the sealing element external surface is at least partially located between the tip portion and the initial engagement portion.

34. The sealing apparatus of claim 32, wherein an external surface of each sealing element defines an initial engagement portion adapted to engage a conduit wall upon application of the setting force, wherein the end of the passage defined by the sealing element external surface is wholly located within the initial engagement portion.

35. The sealing apparatus of claim 32, wherein there are a plurality of passages in each sealing element.

36. The sealing apparatus of claim 1, wherein the first and second sealing elements are resilient.

37. The sealing apparatus of claim 1, wherein the sealing elements are elastomeric.

38. The sealing apparatus of claim 1, wherein each sealing element comprises an annular spring member embedded within the sealing element.

39. The sealing apparatus of claim 1, wherein each sealing element comprises a seal back up in the form of at least one metal band around the circumference of the sealing element.

40. The sealing apparatus of claim 39, wherein the/each metal band defines a plurality of fingers or petals which spread as the sealing element expands.

41. The sealing apparatus of claim 1, wherein, in use and when a pressure differential exists across the sealing apparatus, there is an active sealing element and a substantially redundant sealing element; and wherein each sealing element defines a passage extending through the sealing element from the sealing element external surface to a sealing element internal surface.

42. The sealing apparatus of claim 41, wherein an external surface of each sealing element defines an initial engagement portion adapted to engage a conduit wall upon application of the setting force, wherein each sealing element comprises a base portion and a tip portion, wherein the initial engagement portion is between the tip portion and the base portion of each sealing element, wherein the end of the passage defined by the sealing element external surface is at least partially located between the tip portion and the initial engagement portion.

43. The sealing apparatus of claim 41, wherein an external surface of each sealing element defines an initial engagement portion adapted to engage a conduit wall upon application of the setting force, wherein the end of the passage defined by the sealing element external surface is wholly located within the initial engagement portion.

44. The sealing apparatus of claim 1, wherein each sealing element comprises a base portion and a tip portion; wherein the first sealing element tip portion is engaged with a first side of a ring member; and wherein the second sealing element tip portion is engaged with a second side of the ring member.

45. The sealing apparatus of claim 44, wherein each sealing element defines a passage extending through the sealing element from the sealing element external surface to a sealing element internal surface.

46. The sealing apparatus of claim 44, wherein the ring member defines a communication bore between the annulus and the volume to permit fluid in the annulus actuate at least one of the sealing elements.

47. The sealing apparatus of claim 1, wherein, in use and when a pressure differential exists across the sealing apparatus, there is an active sealing element and a substantially redundant sealing element; wherein in said partially set configuration, an external surface of said sealing element defines an initial engagement portion adapted to engage a conduit wall upon application of the setting force; and wherein in said fully set configuration the area of the external surface of said sealing element in engagement with the conduit wall increases under the influence of fluid pressure on an internal surface of the said sealing element.

48. The sealing apparatus of claim 1, wherein the sealing elements are adapted to be mounted on a mandrel so as to define a volume between each sealing element and the mandrel, wherein in said partially set configuration, an external surface of said sealing element defines an initial engagement portion adapted to engage a conduit wall upon application of the setting force; and wherein in said fully set configuration the area of the external surface of said sealing element in engagement with the conduit wall increases under the influence of fluid pressure on an internal surface of the said sealing element.

49. A sealing apparatus for sealing an annulus, the sealing apparatus comprising:

a deformable first sealing element for, in use, sealing the annulus against pressure from above the sealing apparatus; and a deformable second sealing element for, in use, sealing the annulus against pressure from below the sealing apparatus;

wherein the sealing elements are arranged such that the second sealing element is, in use, above the first sealing element;

wherein a tip portion of each said sealing element is engaged with a ring member which is positioned between the said first and second sealing elements;

wherein said first and second sealing elements have a partially set configuration and a fully set configuration, wherein said first and second sealing elements each comprise a first portion and a second portion;

wherein the first portions are adapted to form initial engagement with a conduit wall through application of a setting force to the first and second sealing elements; and wherein the second portions are adapted to form subsequent engagement with said conduit wall through fluid pressure from above or below the apparatus pressing on an internal surface of each of the first and second sealing elements causing hydraulic expansion of said sealing elements thereby sealing said annulus.

50. The sealing apparatus of claim 49, wherein the first and second sealing elements are adapted to buckle to form an initial engagement with a conduit wall, through application of a setting force to the first and second sealing elements.

51. The sealing apparatus of claim 50, wherein the sealing elements and ring member are mounted on a mandrel; and wherein the ring member is adapted to move with respect to the mandrel; said movement permitting the setting force to be transmitted from one end of the sealing apparatus through the ring member.

52. The sealing apparatus of claim 49, wherein the sealing elements and ring member are mounted on a mandrel; and wherein the ring member is adapted to move with respect to the mandrel; said movement permitting the setting force to be transmitted from one end of the sealing apparatus through the ring member.

53. A sealing apparatus for sealing an annulus, the apparatus comprising:

a first sealing element adapted for sealing the annulus against fluid pressure from above the sealing apparatus and adapted to be actuated by fluid pressure from above the apparatus; and a second sealing element adapted for sealing the annulus against fluid pressure from below the sealing apparatus and adapted to be actuated by fluid pressure from below the apparatus; and arranged, in use, above the first sealing element;

wherein said first and second sealing elements have a partially set configuration and a fully set configuration, wherein said first and second sealing elements each comprise a first portion and a second portion;

wherein in said partially set configuration said first portion of each sealing element is adapted to radially expand into engagement with a wall defining said annulus through application of a setting force to the first and second sealing elements, said setting force deforming each sealing element a first time, and wherein in said fully set configuration said second portion of each sealing element is adapted to radially expand into engagement with the wall through fluid pressure pressing on an internal surface of the sealing element, to thereby seal said annulus with said second portion of each sealing element, said fluid pressure deforming each sealing element a second time.

54. A method of sealing an annulus around a sealing apparatus, the sealing apparatus comprising a first sealing element adapted for sealing the annulus against fluid pressure from above the sealing apparatus and adapted to be actuated by fluid pressure from above the apparatus, said first sealing element having a first portion and a second portion, and a second sealing element adapted for sealing the annulus against fluid pressure from below the sealing apparatus and adapted to be actuated by fluid pressure from below the apparatus, said second sealing element having a first portion and a second portion, the method comprising:

applying a setting force to form initial engagement of the first portion of at least one of the sealing elements with a conduit wall defining the annulus;

applying fluid pressure from above or below the apparatus to an internal surface of one of the sealing elements; and causing said sealing element to hydraulically expand and seal the annulus thereby forming subsequent engagement of the second portion of said sealing element with said conduit wall.

* * * * *

UNITED STATES PATENT AND TRADEMARK OFFICE

CERTIFICATE OF CORRECTION

PATENT NO. : 8,579,038 B2
APPLICATION NO. : 12/513736
DATED : November 12, 2013
INVENTOR(S) : Atkins et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 714 days.

Signed and Sealed this
Twenty-second Day of September, 2015

Michelle K. Lee

Michelle K. Lee
*Director of the United States Patent and Trademark Office*